US009624757B2

(12) United States Patent
Telfer

(10) Patent No.: US 9,624,757 B2
(45) Date of Patent: Apr. 18, 2017

(54) FLUID-ACTUATED DOWNHOLE TOOL

(75) Inventor: George Telfer, Aberdeen (GB)

(73) Assignee: M-I DRILLING FLUIDS UK LTD, Aberdeen (GB)

( * ) Notice: Subject to any disclaimer, the term of this patent is extended or adjusted under 35 U.S.C. 154(b) by 642 days.

(21) Appl. No.: 14/005,815

(22) PCT Filed: Mar. 15, 2012

(86) PCT No.: PCT/GB2012/050579

§ 371 (c)(1),
(2), (4) Date: Feb. 13, 2014

(87) PCT Pub. No.: WO2012/123756

PCT Pub. Date: Sep. 20, 2012

(65) Prior Publication Data

US 2014/0144644 A1 May 29, 2014

(30) Foreign Application Priority Data

Mar. 17, 2011 (GB) ..... 1104531.7

(51) Int. Cl.
*E21B 37/00* (2006.01)
*E21B 37/02* (2006.01)
(Continued)

(52) U.S. Cl.
CPC ..... *E21B 37/00* (2013.01); *E21B 37/02* (2013.01); *E21B 37/04* (2013.01); *E21B 37/10* (2013.01)

(58) Field of Classification Search
CPC ..... E21B 12/06; E21B 37/02; E21B 37/04; E21B 37/10; E21B 37/00
See application file for complete search history.

(56) References Cited

U.S. PATENT DOCUMENTS 2,503,115 A * 4/1950 Livingston ..... E21B 37/02 166/173
3,310,113 A * 3/1967 Maness ..... E21B 37/00 15/104.2
(Continued)

FOREIGN PATENT DOCUMENTS

GB 2338734 A 12/1999
WO 03/006787 A1 1/2003
(Continued)

OTHER PUBLICATIONS

International Search Report for PCT Application Serial No. PCT/GB2012/050579 dated Mar. 4, 2013.
(Continued)

*Primary Examiner* — Brad Harcourt
(74) *Attorney, Agent, or Firm* — David J. Smith

(57) ABSTRACT

A tool for cleaning a casing tubular (13⅜") via a narrower casing tubular (9⅝") or width restriction, has an elongate tool body 1 with axial throughbore 2, box 3 for a corresponding pin 4 to form a tool joint with a workstring 5. In FIG. 1, the body has a nose 6 with fluid discharge channel 7 to pass circulation fluid. An internal shoulder provides a valve seat 8 for a ball 9 passed through the workstring under gravity or during pumping of fluid. Transverse channels 10 receive fluid diverted when the ball is seated within the tool. A side surface 21 has fluid outlet ports 11, and at least one further working surface 22 has tool elements, e.g. bristle-type cleaning elements 23, or scrapers or wipers. Thus the tool body is asymmetrical offering jetting functionality on one side of the tool and mechanical cleaning on the other side.

15 Claims, 6 Drawing Sheets

(51) Int. Cl.
*E21B 37/04* (2006.01)
*E21B 37/10* (2006.01)

(56) References Cited

U.S. PATENT DOCUMENTS

| | | | | |
|---|---|---|---|---|
| 3,892,274 | A * | 7/1975 | Dill | E21B 23/10 166/155 |
| 3,958,641 | A * | 5/1976 | Dill | E21B 7/065 166/223 |
| 4,991,653 | A | 2/1991 | Schwegman et al. | |
| 7,753,125 | B1 | 7/2010 | Penisson | |
| 2007/0261855 | A1 | 11/2007 | Brunet et al. | |

FOREIGN PATENT DOCUMENTS

| | | | |
|---|---|---|---|
| WO | 2009/128915 | A2 | 10/2009 |
| WO | 2010/049723 | A1 | 5/2010 |

OTHER PUBLICATIONS

GB Search Report issued in GB Application No. 1104531.7 dated Apr. 13, 2011; 3 pages.
EP Examination Report issued in EP Application No. 12719429.8 dated Oct. 22, 2014; 6 pages.

* cited by examiner

FLUID-ACTUATED DOWNHOLE TOOL

FIELD OF THE INVENTION

This invention relates to workstring tools required by the oil and gas industry for service and maintenance of a wellbore. The invention relates to a well clean up tool and particularly but not exclusively to its use in a restricted access bore.

BACKGROUND OF THE INVENTION

In the drilling and production of oil and gas wells, a well bore is drilled by means of a plurality of drill pipes provided in sufficient numbers to assemble a rotatable drill string sufficient to drill the required depth. The rotatable drill string is terminated by a drill bit and typically provided with stand-off stabiliser parts periodically throughout the length of the drill string. The drill string is rotated to remove formation ahead of the drill bit, to drill out and thus form a wellbore, and to increase the depth of the well. Drilling mud or other fluid is circulated through the drill string to cool, lubricate and clear the drill bit of cuttings, and to displace the resulting drill cuttings from the bottom of the well to the surface, via an annulus formed between the drill string and the wall of the wellbore.

Periodically, the drill bit is removed from the wellbore and a casing string comprising lengths of tubular casing sections coupled together end-to-end is run into the drilled wellbore and cemented in place. A smaller dimension drill bit is then inserted through the cased wellbore, to drill through the formation below the cased portion, to thereby extend the depth of the well. A smaller diameter casing is then installed in the extended portion of the wellbore and also cemented in place. If required, a liner comprising similar tubular sections coupled together end-to-end may be installed in the well, coupled to and extending from the final casing section. Once the desired full depth has been achieved, the drill string is removed from the well and then a workstring is run-in to clean the well. Once the well has been cleaned out, the walls of the tubular members forming the casing/liner are free of debris so that when screens, packers, gravel pack assemblies, liner hangers or other completion equipment is inserted into the well, an efficient seal can be achieved between these devices and the casing/liner wall.

The step of cleaning the wellbore is usually achieved by inserting a workstring containing dedicated well clean-up or cleaning tools. Typical well cleaning tools known for use in this environment include scrapers, wipers and/or brushes which are held against the internal wall of the casing/liner, to clean away debris as the tool is run-in and then pulled out of the wellbore.

One such type of well cleaning apparatus would be a casing scraper, i.e. a tool whose working surface elements incorporate steel casing scraper blades that scrape the inside of the casing or tubing in the well. The steel blades provided with casing scrapers usually are designed to clean the casing interior of relatively large particles or debris, such as lumps of cement, rocks or caked mud.

A second type of well cleaning apparatus known in the art may be more accurately likened to a brush and the working surface elements thereof incorporate cleaning pads with protruding bristles. Brushing tools are generally used to clean well casings, tubing and the like of smaller debris and or particles than that of scraper tools. Brushing tools may be used to remove oxidation lumps, scale, paraffin and metal burrs for example.

It is also possible to augment the cleaning action of such tools by including means within the tool or string for re-directing fluid flow from a circulation path through a workstring to impinge upon a particular area or zone within the wellbore. The re-directed flow of circulation fluid may be routed via ducts and outlet ports to flush around a workstring in proximity to a mechanically scraped or brushed surface to facilitate return of dislodged detritus in the circulation fluid to surface or otherwise for recovery in a trap within the string.

A workstring for use in cleaning a wellbore casing or liner may include any number of special purpose tools to allow several cleaning activities to be performed in a single trip, but traditional practice requires that a drill string is withdrawn and a workstring (i.e. a string lacking a BHA) is run in hole to perform the cleaning or remedial activity. Downhole tasks may be accomplished using a "workstring" made up of stands of drill pipe, tubing, coil tubing or wireline.

SUMMARY OF THE INVENTION

It will be appreciated by those in the art that generally with increasing depth, the successive casings or liner are of lesser diameter. Also after completion, the presence of the production tubing has to be considered. Therefore, any downhole operation must be conducted using tools which can reach the surface area or wellbore zone to be treated or cleaned.

Therefore in running such a tool, due regard has to be paid to the running clearance and the operational requirements of the tool to be used, which normally means ensuring that the tool is "slim" enough to pass any width restrictions in the path of the workstring on its way down hole.

Sometimes there may be an operational need to re-visit a cased zone in the wellbore, and the operation, for example, may include a milling operation to be conducted which will remove a length of previously installed well formation protective casing thereby exposing a length of intermediate casing. Such a need may arise in a shut down operation when assurance of a sound surface for installation of packers, plugs, cementing etc. is required. Where the well is one that has already been in production, there may be an interest in carrying out treatment of a downhole zone without pulling the completion tubing. Again access through the relatively narrow bore production tubing to clean a wider tubular would present a technical challenge for equipment generally available in the art.

Considering for example, a cleaning tool designed for running in a narrow tubular protective casing with sufficient clearance, it may not be successfully operated in the step change in diameter at the milled away protective casing section. Conversely a tool designed to clean a wider tubular intermediate casing cannot be used to reach the work site to be cleaned below the milled away protective casing in the circumstances contemplated due to clearance restrictions. Similar problems arise where access is required through any narrow conduit, e.g. via production tubing.

An object of the invention is to address the problem of accessing a zone to be treated which is only accessible via a width restriction.

A further object of the invention is to facilitate cleaning of wide bore casings using tools capable of passing a width restriction.

According to the present invention, such problems can be addressed by running a fluid jet actuated tool to be more particularly described hereinafter, and operating same by a method to be explained in more detail hereinbelow.

According to a first aspect of the invention there is provided a downhole fluid-actuated tool, wherein the tool comprises an elongate body having a longitudinal throughbore for passage of fluid, a working surface on a side surface of the elongate body and at least one fluid outlet in a generally opposing side surface of the elongate body, and flow control means operatively associated with the tool for diverting sufficient fluid flow transversely through the fluid outlet to effect lateral movement of the elongate body in a predetermined direction.

The flow control means may comprise valve means provided within the elongate body of the fluid-actuated tool or within another component operatively connected to the body of the fluid-actuated tool to control fluid flow through the body of the cleaning tool. Where the valve is provided in a separate tool body or sub assembly, such would be located below the cleaning tool but it is not necessary for it to be directly attached to the cleaning tool to effect fluid flow control. As long as the fluid flow controlling body is in fluid communication through the workstring with the cleaning tool, the cleaning tool can be actuated.

Actuation of the tool according to the invention provides for the sideways movement of tool to bring a working surface of the tool into an operational position with respect to a downhole surface to be treated by virtue of a reaction developed by ejecting fluid transversely from the body of the tool.

Actuation may be suitably remotely controlled by use of valve means employing a valve seat within a tool in the workstring and an obturator, e.g. a ball or dart, which may be introduced remotely and which is capable of being delivered to the seat when required by gravity or during pumping of circulation fluid.

The flow control means may include a flow channel in the elongate body extending laterally from the throughbore to said at least one outlet on an outer surface of the elongate body. The outlets may include nozzles for creating jet discharges of fluid.

The flow channels would be generally positioned upstream of fluid flow restriction means such as a valve means comprising a seat within the throughbore of the cleaning tool or associated flow controlling body as appropriate, said seat being configured to receive an obturator such as a ball which may be passed through the workstring to encounter and land in the seat to inhibit through flow of fluid. The seat may be a shoulder intruding into the throughbore which simply arrests through passage of the ball to inhibit fluid flow in the longitudinal throughbore, or it may be a chamfered surface around a bore restriction adapted to improve sealing after the ball lands.

The flow channels allow for side diversion of fluid flow from the throughbore when the obturator is seated.

The diverted fluid flow emerges from fluid outlets at the side of the tool, as a jet discharge in a particular direction. Such a directed discharge of fluid mass causes a reaction that is sufficient to effect a displacement of the elongate body in the opposite direction. This is useful for cleaning difficult to reach wide bore casings.

A practical tool may include a series of outlet ports distributed along the length of the tool body, optionally in a linear array diametrically opposite to a working surface of the tool and aligned with the longitudinal axis to achieve the sideways displacement of the tool body as a result of the transverse ejection of fluid from the outlet ports.

In this way a means of controlling the positioning of the tool body relative to a side surface within a wellbore is realized. Control is achievable by use of fluid circulation pumps.

Thus the effect of fluid actuation is to move the cleaning tool in a predetermined manner, especially in a direction generally opposite to the ejected fluid which can bring the working surface of the tool body into proximity to a surface to be treated.

The working surface may comprise wipers, bristles or scrapers to form cleaning elements. The cleaning elements may be mounted in a recess of a working surface of the tool body.

When the workstring in which such a tool is included is also rotated, during a fluid diversion or "jetting" step, the tool can be controllably driven around a surface exterior to the tool, typically in a circular path, e.g. to bring the tool into contact or proximity with a surface to be treated.

If at least one outlet for the fluid is disposed at an angle to others of the cleaning tool body, e.g. not directly aligned with a notional radius from the longitudinal axis but at an angle thereto, a turning moment can be added to the lateral displacement thereby introducing a rotational component to the motion created by fluid discharge.

If the tool is rotatably mounted, e.g. on a swivel bearing, and at least one fluid outlet port is angled as mentioned above then it is possible avoid the need to rotate the workstring. This would also permit use of workstrings other than those formed of drill pipe for deployment of the tool.

This may be useful in deployment through completion tubing.

Typically, the tool would be adapted for deployment on a workstring by provision of pin and box ends for connection with corresponding drill pipe ends to form a tool joint. The tool may or may not be the last component in the string.

According to another aspect of the present invention there is provided a casing cleaning tool for deployment on a workstring within a cased wellbore, comprising a tool body adapted to be passed through a tubular casing, said body having an axial throughbore for circulation of fluid through the tool, valve means configured within the throughbore for use in diverting fluid flow within the tool at least in part to channels within the tool body, fluid ports in the tool body for passing diverted fluid from the channels under pressure and out of the tool body when required, and cleaning elements provided upon a working surface of the tool body, wherein at least one fluid port is arranged on a side surface opposite to said working surface, whereby upon passing diverted fluid under pressure from said at least one port in one direction, the tool body is urged to move in the opposite direction due to the reaction created by a fluid jet emerging from said port.

By this solution, several benefits accrue, namely a jet outflow action is accomplished, which results in a reaction whereby the tool body is displaced off centre with respect to the longitudinal axis of the casing tubular to be cleaned, and the cleaning element is thereby urged towards the surface to be cleaned, and when the workstring is also rotated slowly, the tool body is caused to traverse around the surface to be cleaned enabling it to be both mechanically cleaned by contact with the cleaning element(s) and fluidically cleaned by the fluid jet(s) impinging on the surface from the opposite side of the tool body.

Fluid flow control may be achieved by valve means which may comprise a valve seat located within the fluid path in the throughbore within the tool body, or within an associated sub operatively connected with the tool body, which seat is configured to receive an obturator conveyed to it under gravity or during circulation of fluid, and to then inhibit fluid flow sufficiently when the obturator is seated to effect re-direction of fluid into channels leading to jetting ports.

The channels and ports may be configured to ensure that the fluid jet(s) emerging from the tool body are directed laterally away from the tool body. A suitable configuration has a series of longitudinally spaced jetting ports aligned with a radius. However, other configurations are capable of ejecting sufficient fluid to effect a reaction.

The pressure of emergent fluid jets may be enhanced by providing nozzles in the ports.

In an embodiment of the tool a serial array of jetting ports is arranged longitudinally upon a surface of the tool body which is directly opposite to a working surface bearing a cleaning element.

The cleaning elements may comprise wipers, bristles or scrapers. The cleaning elements may be mounted in a recess of a working surface of the tool body.

The cleaning tool may be configured for cleaning the narrower bore tubing during transit to the wider bore when fluid is not diverted through a channel and a port in a side wall of the tool body.

In embodiments of the invention, the cleaning tool is configured for transit through production tubing.

In various embodiments of the tool according to any aspect of the invention the tool body is of asymmetric form, having working surfaces for effecting a treatment on or around a first side surface and having on a generally opposite side surface outlet means for discharging a fluid mass thereby effecting a displacement of the tool in a controllable manner.

The working surfaces and fluid outlets may be formed on a tool body comprising a mandrel adapted to be attached to a workstring. An axial throughbore in the mandrel may be positioned centrally or off centre.

Further according to the present invention there is provided a method of treating a downhole surface within a bore of a certain width, particularly a conduit surface which is accessible only via a conduit of narrower width, which method comprises, running a fluid actuated treatment tool adapted to pass through the narrower conduit on a workstring into the wellbore, said treatment tool including valve means for controlling and redirecting fluid, circulating fluid through the treatment tool, providing an obturator to the valve means to seat same in the valve means to restrict through-flow and re-direct fluid out of the treatment tool to be ejected to one side to effect a displacement reaction of the treatment tool, typically off centre, towards the downhole surface to be treated.

The method may comprise the step of rotating the workstring to cause a working surface of the displaced treatment tool to traverse around the surface to be treated whilst fluid is ejected.

The method may comprise the step of reciprocating the workstring to cause a working surface of the displaced treatment tool to move longitudinally with respect to the surface to be treated whilst fluid is ejected.

The treatment tool may be a cleaning tool, in which the working surface may comprise cleaning elements selected from the group consisting of wipers, bristles and scrapers, whereby the method may comprise treating the surface by a treatment selected from the group consisting of wiping, brushing and scraping, and the method may be applied in cleaning a downhole surface accessible through a width restriction such as a narrow bore tubing or tubular conduit.

By this method, whereby the treatment tool may be passed through the narrow bore conduit into a wider bore conduit, and displaced off centre with respect to the longitudinal axis of the bore, by the diversion of fluid flow into a sideways jet, cleaning elements provided on the treatment tool are urged to clean a surface of the wider bore conduit and by causing the workstring to rotate, the cleaning tool is move progressively around the wider bore tubular in a circular path to successively clean the surface with the cleaning element and then by the jetting action achieved by fluid diversion.

In a variant of the method the tool is swivel mounted and provided with additional angled fluid outlets to impart rotational motion to the tool whilst fluid is discharged so that complete surface treatment of the surface is achievable without rotating the workstring.

In this way an objective of the invention is achievable by fluidically causing the cleaning tool to move off centre with respect to the throughbore of the conduit to be cleaned, and become eccentrically positioned for a functional cleaning mode of operation.

DESCRIPTION OF THE DRAWINGS

In the accompanying drawings, the cleaning tool is represented in sectional view in FIG. 1 in its transitory position through the narrower bore casing tubular prior to entry to the wider bore casing tubular.

EMBODIMENTS OF THE INVENTION

Figure 1:
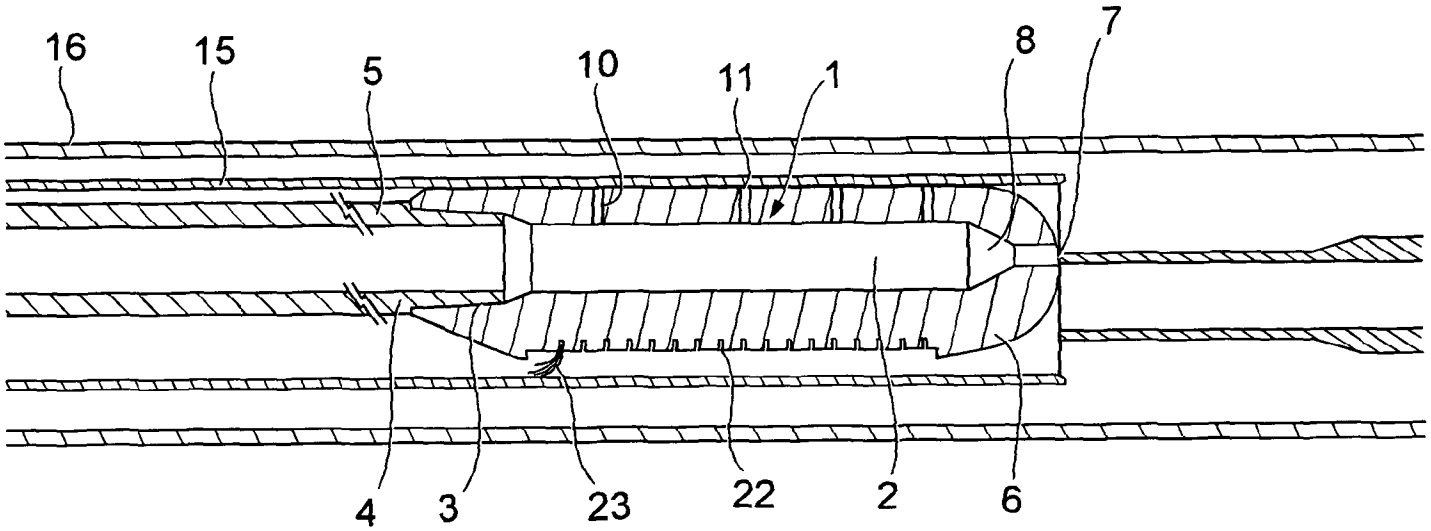

Referring to FIG. 1, a casing clean up tool suitable for accessing and cleaning a casing tubular (say 13⅜" casing) via a narrower casing tubular (say 9⅝") presenting a width restriction, comprises an elongate tool body 1 having an axial throughbore 2, and a box 3 for receiving a corresponding pin 4 to form a tool joint with a workstring 5. In the embodiment of FIG. 1, the tool body has a nose 6 with fluid discharge channel 7 to allow through flow of circulation fluid. In other embodiments the nose may be substituted by an open pin for engaging a corresponding box of another component of the workstring e.g. a tool sub or drill pipe.

Figure 2:
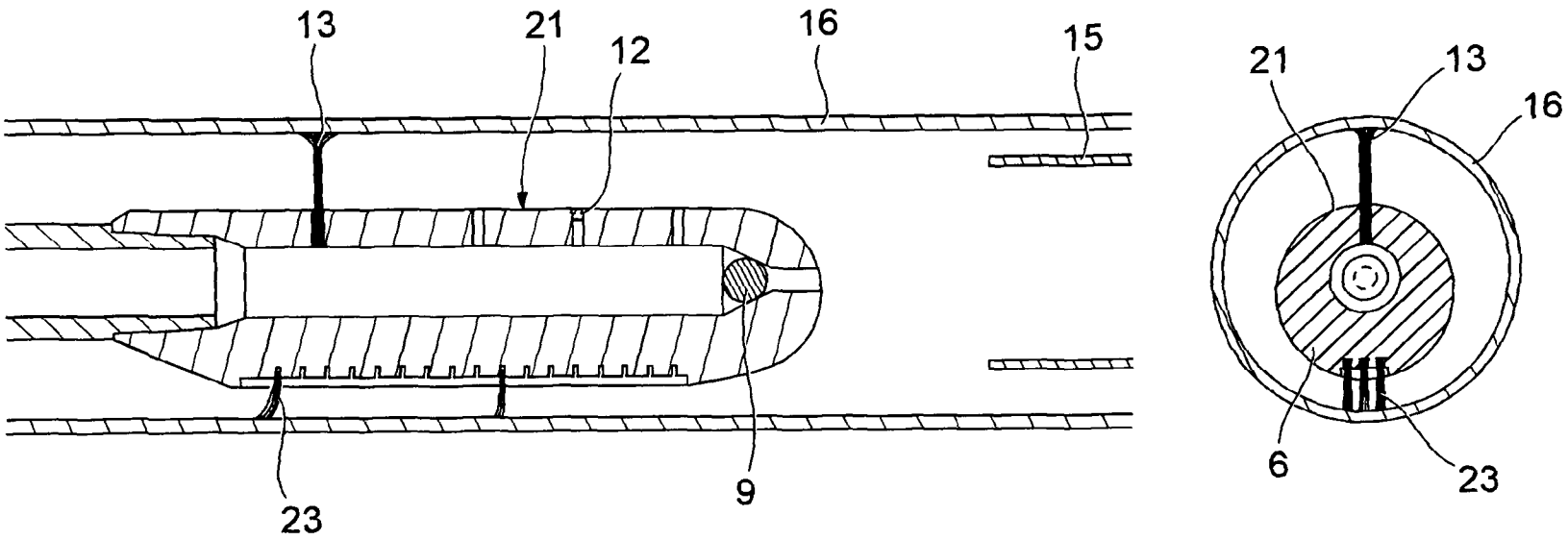
FIG. 2 shows a sectional view of the cleaning tool deflected by jetting of fluid and eccentrically positioned in the wider bore casing tubular during a cleaning operation.

Referring again to FIG. 1, and also to FIG. 2, the tool body of this embodiment incorporates an internal shoulder serving as a valve seat 8 configured to receive an obturator in the form of a ball 9 capable of being passed to the seat through the workstring under gravity or during pumping of fluid.

The tool body includes transversely directed fluid diversion channels 10 to receive fluid diverted when the ball is seated within the tool.

The tool body has a side surface 21 provided with fluid outlet ports 11, and at least one further working surface 22 provided with tool elements, here bristle-type cleaning elements 23, but scrapers or wipers are also contemplated. Thus the tool body is asymmetrical with respect to functionality in that one cleaning action is derived from the jetting functionality on one side of the tool and another, mechanical cleaning with bristles on the other side.

The channels 10 and ports 11 are configured to ensure that the fluid jet(s) emerging from the tool body are directed laterally away from the tool body. The ports 11 are arranged in a longitudinally aligned series or array on a surface of the tool body to provide a plurality of parallel jets 13 emerging in a radial direction, the pressure of which fluid jets may be enhanced by providing a nozzle 12 (FIG. 2) in each port 11.

The tool may be run in on the workstring to a zone to be treated. The zone may be an exposed surface of intermediate casing 16, due to milling away of a protective casing or liner 15 (FIG. 2).

The treatment to be applied may therefore be cleaning of the exposed length of casing 16.

In such a use of the tool, the tool is run in on the workstring to the site of the milling operation, and a ball may be circulated in the fluid to the tool. As the ball seats in the tool, flow is impeded and the fluid circulation pump operator may detect this. If the pumping of circulation fluid is continued or possibly increased if necessary, fluid finds an outlet 11 via channels 10, and the resulting ejection of fluid (jetting) from that one side 21 of the tool causes a tool body displacement reaction in response to move the tool body in the opposite direction to the ejected fluid. Whilst such a transverse jet outflow action is continued, the tool body is displaced off centre with respect to the longitudinal axis of the wellbore.

The displacement brings the opposite side working surface 22 into proximity with an external casing surface, and allows the bristle cleaning elements 23 to contact the casing surface.

By rotation of the workstring whilst the tool body is displaced the tool body is caused to traverse around the surface to be cleaned enabling it to be both mechanically cleaned by contact with the cleaning element(s) and fluidically cleaned by the fluid jet(s) impinging on the surface from the opposite side of the tool body.

The tool may be used in a method of cleaning a wider wellbore casing tubular 16 which is accessible only via a narrower wellbore casing tubular 15. The method may include the steps of running a cleaning tool 1 adapted to pass through the narrower casing tubular on a workstring into the wellbore, said cleaning tool including valve means 8 for controlling and redirecting fluid, circulating fluid through the cleaning tool, providing an obturator 9 to the valve means to seat same in the valve means to restrict through-flow and re-direct fluid out of the cleaning tool to one side to effect a displacement of the cleaning tool off centre to urge cleaning elements 23 on another side 22 of the cleaning tool into contact with a surface of the wider wellbore casing tubular 16 to be cleaned, and rotating the workstring to cause the cleaning tool to traverse around the surface to be cleaned.

By this method, whereby the cleaning tool 1 is passed through the narrow bore tubular 15 into a wider bore tubular 16, and displaced off centre by the diversion of fluid flow into a sideways jet, the cleaning elements 23 of the cleaning tool are urged to clean an otherwise inaccessible surface of the wider bore tubular 16.

In an alternative embodiment the cleaning tool lacks a valve component and is operatively connected to a valved tool below the cleaning tool to enable the fluid flow to be obstructed and diverted out through the cleaning tool jet outlets to achieve the same displacement effect.

Figure 4:
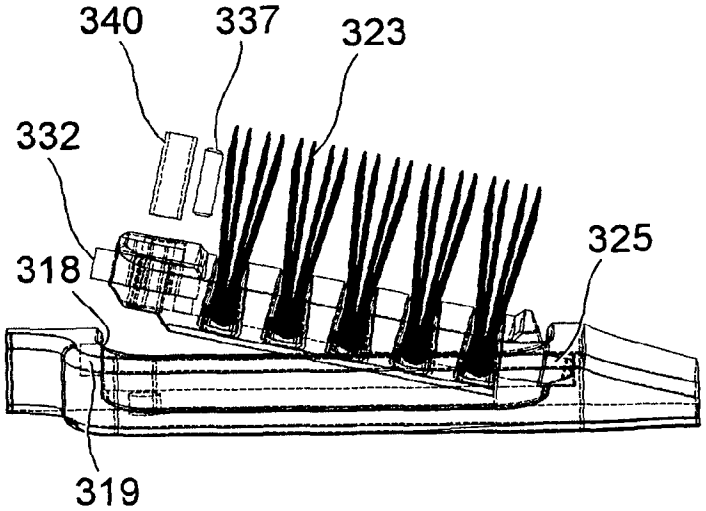
FIG. 4 is a side view of a part of a cleaning tool body, and a bristle cleaning element partially inserted into the working surface of the cleaning element body.
Figure 3:
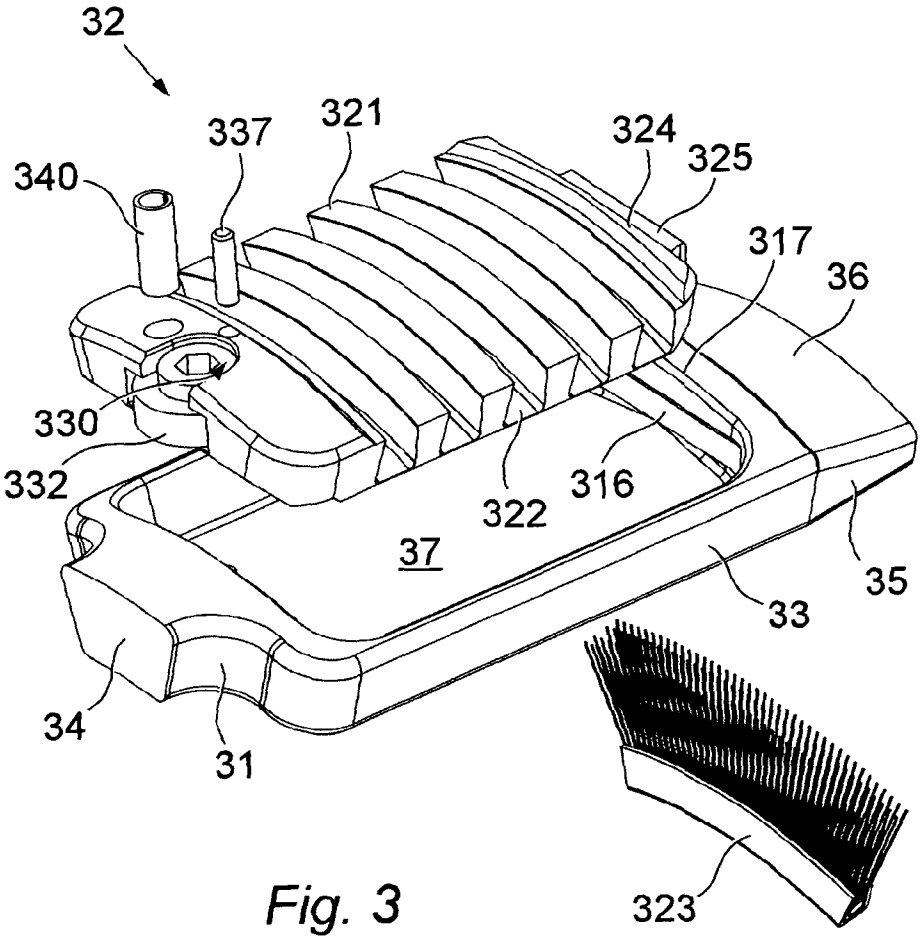
FIG. 3 is an exploded perspective view from above and to one side of a cleaning element suitable for mounting on a working surface of a cleaning tool, and a bristle segment adjacent for insertion into the cleaning element.

Turning to FIGS. 3 and 4, a cleaning element attachable to a working surface of a tool body part 31 in a removable manner is shown which is provided with bristle elements for cleaning a downhole surface when the working surface of the tool body is presented to the downhole surface and the tool is reciprocated upon or traverses over the downhole surface.

The tool body part 31 suitably adapted for receiving a brush pad cleaning element 32 has opposed parallel sidewalls 33 and contoured ends 34, 35, with an inclined surface 36 and an opening 37 within the body part 31 to receive brush pad cleaning element 32.

Cleaning element 32 is an oblong element of curved longitudinal cross-section, and having an upper surface 321 with slots 322 adapted to receive by insertion work surface segments of various types, e.g. in this embodiment carrying bristles 323 to assemble a brush type cleaning element.

A shorter dimension edge 324 of the cleaning element 32 provides tongue 325 for insertion into a corresponding groove 316 in an end wall 317 (within the opening 37) in the body 1. An opposite edge of the cleaning element 32 has a part-circular recess with a part-circular peripheral lip around an upper edge of the recess, the said recess being of a shape (e.g. accessible via an inverted T-shaped aperture) suited to receive a fastener component of first and second width dimensions wherein the first width dimension can be accommodated within the full width of the recess but is greater than the width of the headspace within the lip, and the second width dimension can be accommodated within the headspace within the lip.

An asymmetric fastener component adapted to be positioned in the recess as a retainer piece to allow the cleaning element 32 to be held in the opening 37 of the body part 31, has a core 330 with a socket adapted to receive a hexagonal pin driving tool (not shown). Referring to FIG. 3, the core 330 has a flange 332 extending part way around it, and the flange 332 has concave curved surfaces (not shown) spaced one from the other at substantially diametrically opposed locations to accommodate contact with roll pins to be inserted during assembly, and adjacent to one of said curved surfaces, there is provided a further concave surface (not shown) to accommodate contact with a shear pin fastener 337.

The fastener component is sized to permit it to rotate when mounted within the part-circular recess, and when turned by a driving tool to present at least part of the flange 332 projecting out of the recess to serve as a means of forming an inter-fitting engagement with a groove 319 (FIG. 4) in a corresponding end wall 318 of the body 1.

Roll pins (upper pin 340 shown) are provided for use in locating the fastener component 329 in predetermined rotational configurations within the recess.

Shear pin 337 is provided to inhibit unintended rotation of the fastener component from a predetermined position set by location of the roll pins, and to lock the fastener component in a retaining configuration for normal use of the cleaning tool, even if a roll pin is lost from the assembly.

A plurality of brush segments 323 are provided for insertion into slots 322 in the cleaning element 32, to provide a brush pad assembly upon the working surface of the tool body part 31.

Such cleaning elements are quickly and easily interchanged for altering functionality of any embodiment of the invention.

Figure 5:
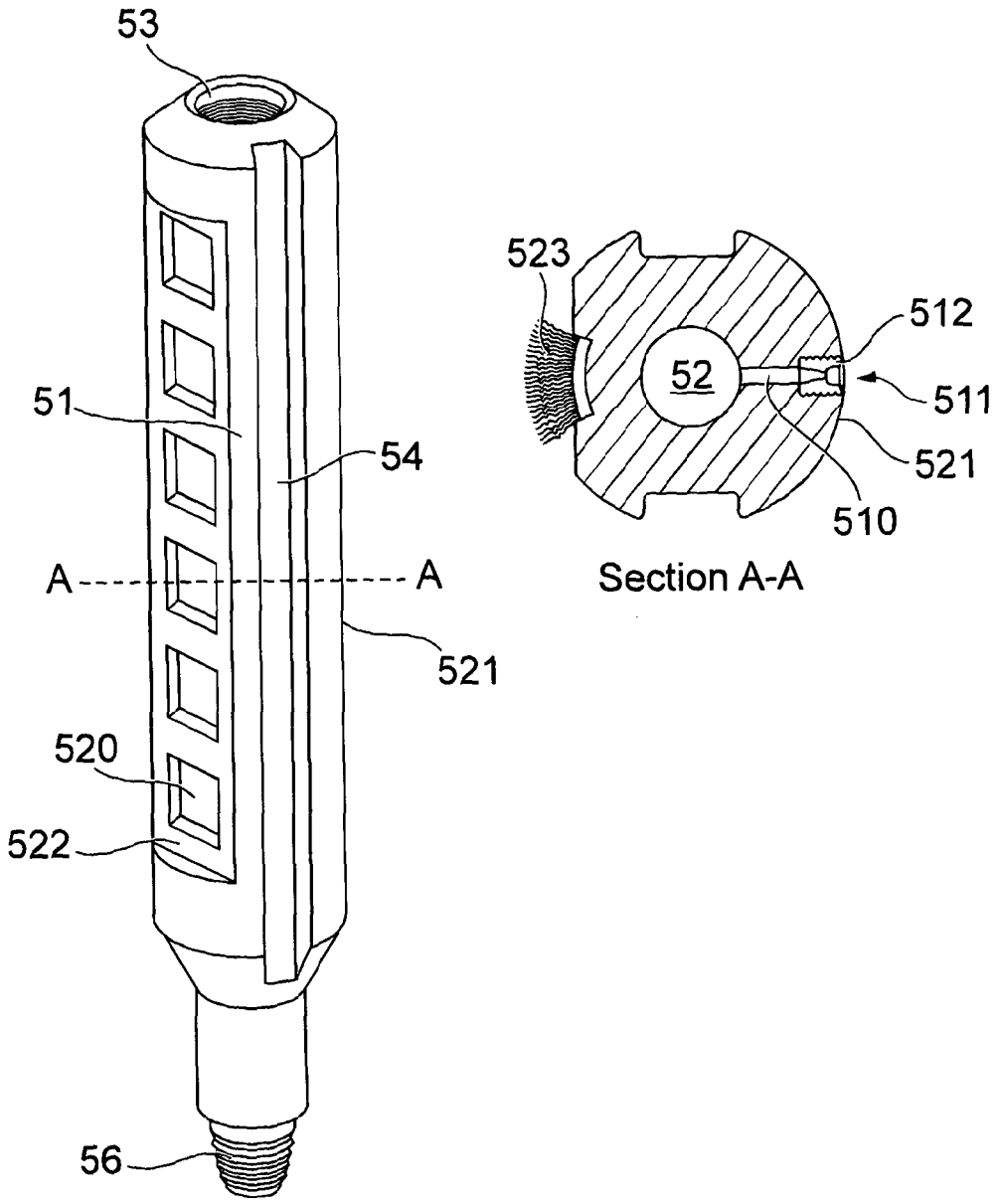
FIG. 5 is perspective view from above and to one side of an embodiment of a jet actuated bristle cleaning tool with a transverse section on the line A-A, showing concentric bore and opposed bristle and jetting functional parts.

Referring now to FIG. 5, a fluid-actuated tool comprises an elongate tool body 51 having an axial concentric throughbore 52, and a tapped bore 53 for receiving a corresponding threaded pin (not shown) to form a tool joint with a workstring (not shown). In this embodiment the tool body 51 has a lower pin 56 for engaging a corresponding box of another component of the workstring e.g. a fluid circulation valve tool sub assembly or drill pipe, and has an open end to allow through flow of circulation fluid.

This embodiment may include an internal shoulder or valve seat (not shown) or be associated with such valve means in a flow control sub (not shown) fluidically connected to the tool body in the workstring, which together with a ball obturator (not shown) serves as a fluid redirecting means to effect fluid-actuation of the tool body when required.

The tool body includes transversely directed fluid diversion channels 510 to receive fluid diverted when a ball is seated upon the seat or arrested by encountering the shoulder thereby creating a back pressure build up which can be relieved and utilized via fluid outlet ports 511 in tool body side surface 521.

The tool body 51 has at least one further working surface 522 provided with tool element recesses 520, adapted to receive bristle-type cleaning elements 523, but pads bearing scrapers or wipers are also contemplated.

The channels 510 and ports 511 are configured to ensure that the fluid jet(s) emerging from the tool body are directed laterally away from the tool body. The ports 511 are arranged in a longitudinally aligned series or array on a surface of the tool body to provide a plurality of parallel jets emerging in a radial direction, the pressure of which fluid jets may be enhanced by providing a nozzle 512 in each port.

Longitudinally aligned fluid-bypass channels 54 are evident in opposite side surfaces of the tool body 51.

Figure 6:
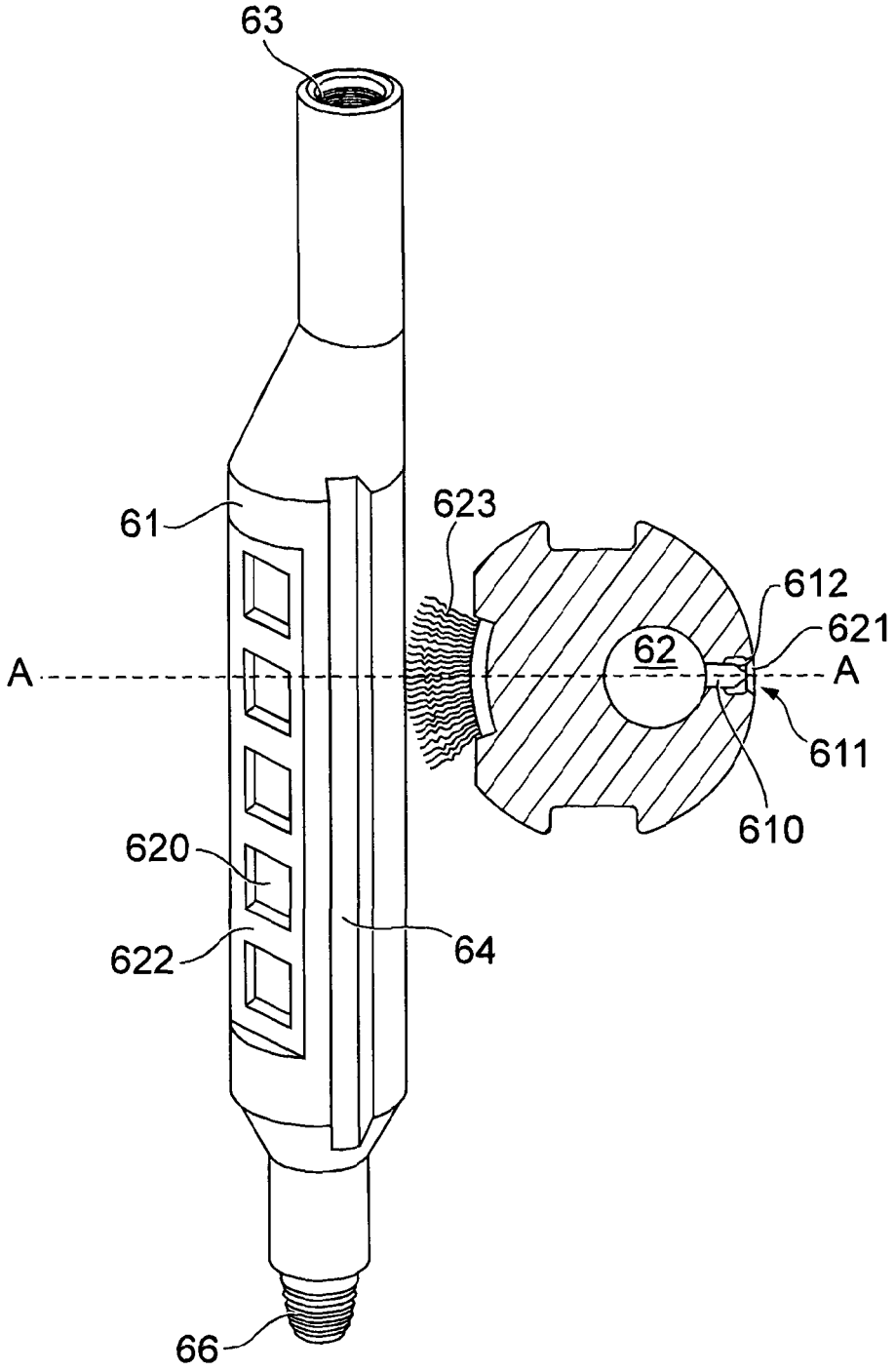
FIG. 6 is a perspective view from above and to one side of an embodiment of a jet actuated bristle cleaning tool with a transverse section on the line A-A, showing eccentric bore and opposed bristle and jetting functional parts.

A further embodiment is illustrated in FIG. 6, which shows a fluid-actuated tool which comprises an elongate tool body 61 having a longitudinally aligned eccentric throughbore 62, and a tapped bore 63 for receiving a corresponding threaded pin (not shown) to form a tool joint with a workstring (not shown). In this embodiment the tool body 61 has an open ended lower pin 66 for engaging a corresponding box of another component of the workstring e.g. a fluid circulation valve tool sub assembly or drill pipe, and to allow through flow of circulation fluid.

This embodiment may include within the throughbore 62, or be associated with, valve means provided in a fluid flow control sub fluidically connected to the tool body in the workstring, which together with a ball obturator (not shown) serves to effect fluid-actuation of the tool body when required.

The tool body includes transversely directed fluid diversion channels 610 to receive fluid diverted when a ball is seated upon the valve seat.

The tool body 61 has a side surface 621 provided with fluid outlet ports 611, and at least one further working surface 622 provided with tool element recesses 620, adapted to receive bristle-type cleaning elements 623, but pads bearing scrapers or wipers are also contemplated.

The channels 610 and ports 611 are configured to ensure that the fluid jet(s) emerging from the tool body are directed laterally away from the tool body. The ports 611 are arranged in a longitudinally aligned series or array on a surface of the tool body to provide a plurality of parallel jets emerging in a radial direction, the pressure of which fluid jets may be enhanced by providing a nozzle 612 in each port.

Longitudinally aligned fluid-bypass channels 64 are evident in opposite side surfaces of the tool body 61.

Figure 7:
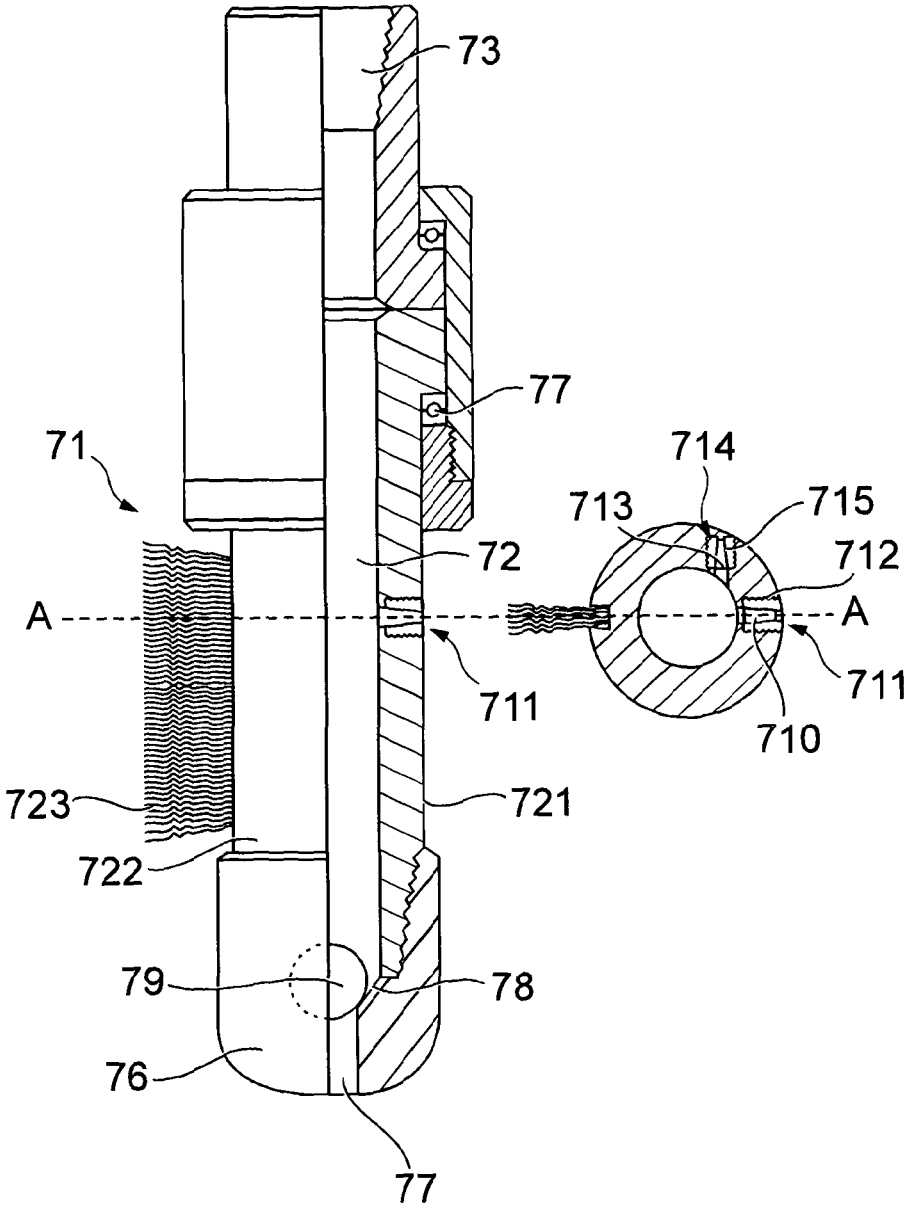
FIG. 7 is a side view partially cut away in vertical section of a further embodiment of a jet actuated bristle cleaning tool with swivel bearing, and a transverse section on the line A-A showing concentric bore and opposed bristle and jetting functional parts.

Referring now to FIG. 7, there is shown a fluid-actuated rotatable tool which comprises an elongate tool body 71 having an axial throughbore 72, and a box 73 for receiving a corresponding pin (not shown) to form a tool joint with a workstring (not shown). In this embodiment the tool body 71 has a nose 76 with fluid discharge channel 77 to allow through flow of circulation fluid. The tool body is configured to pass within production tubing.

This embodiment includes within the throughbore 72, a stop shoulder or seat 78 which together with a ball obturator 79 serves as fluid diversion means to effect fluid-actuation of the tool body when required.

The tool body includes transversely directed fluid diversion channels 710 to receive fluid diverted when a ball is seated upon the valve seat.

The tool body 71 has a side surface 721 provided with fluid outlet ports 711, and at least one further working surface 722 provided with bristle-type cleaning elements 723, but pads bearing scrapers or wipers are also contemplated options.

The channels 710 and ports 711 are configured to ensure that the fluid jet(s) emerging from the tool body are directed laterally away from the tool body. The ports 711 are arranged in a longitudinally aligned series or array on a surface of the tool body to provide a plurality of parallel jets emerging in a radial direction, the pressure of which fluid jets may be enhanced by providing a nozzle 712 in each port.

The tool body 71 is mounted upon a swivel bearing assembly 77 so that the body 71 can be rotated without turning the workstring to which the tool may be attached in use.

In order to actuate the tool in a rotational sense, additional transverse flow channels 713 with outlet ports 714 including jetting nozzles 715 are provided in the tool body side surface which flow channels 713 are angled with respect to fluid diversion channels 710 so as to introduce a turning moment when fluid is ejected through such channels. In use the tool body can be displaced laterally by jet discharge from the nozzles 712, and turned upon the swivel bearing 77 by jet discharge from the nozzles 715.

The invention claimed is:

1. A tool, wherein the tool comprises:

an elongate body having side walls extending along a length of the elongate body and a longitudinal throughbore for passage of fluid, wherein the side walls provide an outer perimeter around the longitudinal throughbore;

a working surface provided on a first side surface along the outer perimeter of the elongate body;

at least one fluid outlet extending through the side walls of the elongate body at a generally opposing second side surface along the outer perimeter of the elongate body;

at least one transverse fluid outlet extending through the side walls of the elongate body at a third side surface along the outer perimeter of the elongate body, the at least one transverse fluid outlet being angled with respect to the at least one fluid outlet, wherein, along the perimeter of the elongate body, the third side surface having the at least one transverse fluid outlet is located between the first side surface having the working surface and the second side surface having the at least one fluid outlet; and and flow control means operatively associated with the tool for diverting sufficient fluid flow transversely through the at least one fluid outlet to effect lateral movement of the elongate body in a predetermined direction and for diverting sufficient fluid flow transversely through the at least one transverse fluid outlet to effect rotational movement of the elongate body.

2. The tool according to claim 1, wherein the flow control means comprises valve means provided within the elongate body of the fluid-actuated tool to control fluid flow through the body of the fluid-actuated tool.

3. The tool according to claim 1, wherein the flow control means comprises valve means provided within another component operatively connected to the body of the fluid-actuated tool to control fluid flow through the body of the fluid-actuated tool.

4. The tool according to claim 1, wherein the flow control means comprises a valve seat within a workstring and an obturator to be introduced remotely and capable of being delivered to the valve seat when required under gravity or during circulation of fluid.

5. The tool according to claim 4, wherein the valve seat is provided within the fluid path in the throughbore within the elongate body of the tool.

6. The tool according to claim 1, wherein the flow control means comprises a flow channel in the elongate body extending laterally from the throughbore to said at least one outlet on an outer surface of the elongate body.

7. The tool according to claim 1 wherein said at least one fluid outlet comprises a nozzle for discharging a jet of fluid.

8. The tool according to claim 1 wherein a series of outlet ports is distributed along the length of the elongate body.

9. The tool according to claim 1, wherein the working surface comprises a cleaning element selected from the group consisting of wipers, bristles and scrapers.

10. The tool as claimed in 9, wherein the cleaning element is mounted in a recess of the working surface of the elongate body.

11. The tool according to claim 1, wherein the fluid-actuated tool is rotatably mounted in a workstring.

12. The tool according to claim 1, wherein, along the outer perimeter of the elongate body, a first distance from the second side surface having the at least one fluid outlet to the third side surface having the at least one transverse fluid outlet is less than a second distance from the first side surface having the working surface to the third side surface having the at least one transverse fluid outlet.

13. A cleaning tool for deployment on a workstring within a cased wellbore, comprising:

a tool body adapted to be passed through a tubular casing, said tool body having an axial throughbore for circulation of fluid through the tool;

valve means configured within the throughbore for use in diverting fluid flow within the tool at least in part to channels within the tool body;

a first fluid port in side walls of the tool body and a second fluid port in the side walls the tool body, for passing diverted fluid from the channels under pressure and out of the tool body when required; and cleaning elements provided upon a working surface on the side walls of the tool body;

wherein the first fluid port is arranged on a side surface opposite to said working surface, whereby upon passing diverted fluid under pressure from the first fluid port in one direction, the tool body is urged to move in the opposite direction due to the reaction created by a fluid jet emerging from the first fluid port;

wherein the second fluid port is arranged on the tool body, whereby upon passing diverted fluid under pressure from the second fluid port, the tool body is urged to rotate, and wherein, along the side walls of the tool body, the second fluid port is arranged between the first fluid port and the cleaning elements.

14. The cleaning tool according to claim 13, wherein the first fluid port comprises a serial array of jetting ports arranged longitudinally upon a surface of the tool body which is directly opposite to the working surface bearing a cleaning element selected from the group consisting of wipers, bristles and scrapers.

15. A method of treating a downhole surface within a wellbore of a first width which is accessible only via a conduit of second width, the second width being less than the first width, the method comprises:

running a fluid actuated treatment tool adapted to pass through the conduit on a workstring into the wellbore, said treatment tool including valve means for controlling and redirecting fluid;

circulating fluid through the treatment tool; and providing an obturator to the valve means to seat the obturator in the valve means to restrict through-flow and redirect fluid out of the treatment tool to be ejected from a first side surface of the treatment tool to effect a displacement reaction of a second side surface of the treatment tool towards the downhole surface to be treated and to be ejected from a third side surface of the treatment tool to effect rotational movement of the treatment tool, wherein the second side surface of the treatment tool for treating the downhole surface comprises at least one cleaning element selected from the group consisting of one or more wipers, one or more bristles and one or more scrapers.

* * * * *